United States Patent [19]

Kayama

[11] Patent Number: 4,502,289

[45] Date of Patent: Mar. 5, 1985

[54] COLD WATER SUPPLY SYSTEM

[75] Inventor: Tsutomu Kayama, Nishisonogi, Japan

[73] Assignee: Mitsubishi Denki Kabushiki Kaisha, Tokyo, Japan

[21] Appl. No.: 519,514

[22] Filed: Aug. 1, 1983

[30] Foreign Application Priority Data

Aug. 6, 1982 [JP] Japan ..... 57-137707

[51] Int. Cl.[3] ..... F25D 17/02

[52] U.S. Cl. ..... 62/185; 62/201

[58] Field of Search ..... 62/185, 201, 435, 434, 62/99; 165/35, 36, 40; 236/12.1, 12.11, 12.12, 12.14, 12.15

[56] References Cited

U.S. PATENT DOCUMENTS

| | | | |
|---|---|---|---|
| 1,545,938 | 7/1925 | Bren | 236/12.14 |
| 3,383,037 | 5/1968 | Vince | 236/12.12 |
| 3,434,488 | 3/1969 | Talbot | 236/12.12 |
| 4,415,847 | 11/1983 | Galloway | 62/185 |

OTHER PUBLICATIONS

Mitsubishi Denki Giho, vol. 56, No. 4 (Apr.) 1982 by A. Sakai et al. on Control System for Complete Air Conditioning and Ventilation for the Hong Kong Subway System, p. 43(315); (3) Refrigerator Plant.

*Primary Examiner*—Harry B. Tanner

*Attorney, Agent, or Firm*—Wenderoth, Lind & Ponack

[57] ABSTRACT

A cold water supply system includes an agitator tank in a cold water supply tank for receiving the cold water from a refrigerating units and a bypass pipe line for directing a calculated amount of return water from the load into the agitator tank. A temperature sensor for sensing the return water temperature is provided and another temperature sensor for sensing the refrigeration unit outlet temperature is provided for controlling regulating means in accordance with the sensed temperatures for automatically regulating the cold water temperature supplied into the agitator tank to a predetermined temperature.

1 Claim, 4 Drawing Figures

COLD WATER SUPPLY SYSTEM

BACKGROUND OF THE INVENTION

This invention relates to cold water supply systems, and more particularly to cold water supply systems in which a computer is incorporated into a refrigeration plant and the optimum capacity control of the variable capacity refrigerator operation is directly controlled through the use of the DDC (Direct Digital Control) function.

One typical conventional system of the type the present invention is concerned with is illustrated in FIGS. 1 and 2. In FIG. 1, in order to ensure that a necessary predetermined amount of cold water or brine at a constant predetermined temperature is always maintained in a supply tank 10, the water level in the supply tank 10 is monitored by a level sensor 12 which supplies a level signal to a computer 14. The computer 14, when a decrease of the cold water level is detected by the level signal from the level sensor 12, starts pumps 16, valves 18 and refrigerators 20 in sequence. At this time, the computer 14 determines and controls the number of the refrigerators 20 to be operated according to the cold water level and the cold water level change rate in the supply tank 10. The computer 14 also automatically controls the pumps 16 and the valves 18 correspondingly. A temperature sensor 26 is disposed in the tank 10 and a level sensor 28 is disposed in the tank 24.

FIG. 2 illustrates the operation of the above described conventional supply system in a flow chart. In FIG. 2, it is seen that a function 101 determines if the cold water level within the supply tank 10 is sufficient for the supply of the water to a load (not illustrated). If the water level is sufficiently high, the refrigeration units of the refrigeration system 20 are not started at all as shown in a function 102. If the water level is not sufficiently high, only one refrigerator 20 is started to operate as shown by a function 103, and the computer 14 calculates and determines in advance which of the two cold water supply amounts, from the refrigerator 20 to the supply tank 10 or the cold water discharge amount from the supply tank 10 to the unillustrated load, is larger from the level change rate as shown in a function 104. The level change rate used herein can be obtained based on the signal from the level sensor 12. When it is determined from the above level change rate that the water level in the supply tank 10 is being lowered, a function 105 determines whether or not the refrigeration system 20 should be stopped with the actual water level also taken into consideration. If the water level is being lowered, a function 106 determines whether or not one more refrigerator 20 of the refrigeration system should be started taking the actual water level also into consideration.

Also, the refrigerating capacity of each of the refrigerators 20 can be changed by the automatic vane control function of turbo-refrigerators, and in order to maintain the cold water temperature constant, the computer 14 automatically controls the refrigeration capacity of the refrigerators 20 so that the cold water temperature at the outlet of the refrigerators 20 is kept constant through the use of the difference between the return cold water temperature measured by a temperature measuring sensor 22 for sensing the temperature of the return water received in return water tank 24 and the temperature of the supply cold water in the supply water tank 10 which latter temperature is kept at a constant set value.

Thus, the computer 14 functions to effect the start-stop control of the refrigeration system, i.e., how many of the pumps 16, the valves 18 and the refrigerators 20 are to be started or stopped by the detection of the level, namely the determination of the amount of the supply water by the level detection sensor 12, and the computer 14 also functions to control the refrigerating capacity of the refrigerators 20 that are actuated by the above start-stop control through the use of the temperature of the return cold water from the return water measuring temperature sensor 22.

Since the conventional cold water supply system is constructed as described above, the number of the refrigerators that should be started up is determined according to the amount of the supply cold water, and the refrigeration capacity of the started refrigerator is automatically determined in accordance with the difference between the cold water temperature and the discharge set temperature (set value). Therefore, with the conventional cold water supply system, the refrigerators sometimes must be operated at a low load factor when the difference between the water temperatures is small which results in inefficient operation, and this is further aggravated when a plurality of refrigerators are started and operated in parallel.

SUMMARY OF THE INVENTION

Accordingly, the object of the present invention is to provide a cold water supply system high in operating efficiency.

With the above object in view, the present invention resides in a cold water supplying system which comprises an agitator tank within a cold water supply tank for receiving the cold water from a refrigerating system, a bypass piping means for directing a calculated amount of return cold water into the agitator tank, a temperature sensor for sensing the temperature of the return cold water, a second temperature sensor for detecting the water temperature discharged from the refrigerating system, and regulating means for automatically regulating the temperature of the cold water to be supplied into the agitator tank to a predetermined temperature.

Thus, according to the present invention, a refrigeration plant employing variable capacity refrigerators is suitably controlled through the use of the operating function, forecasting function and DDC function to directly control the capacity of the refrigerators, thereby realizing optimum temperature control and high efficiency refrigerator operation.

BRIEF DESCRIPTION OF THE DRAWINGS

The invention will become more readily apparent from the following description of the preferred embodiment taken in conjunction with the accompanying drawings, in which.

DESCRIPTION OF THE PREFERRED EMBODIMENT

Figure 1:
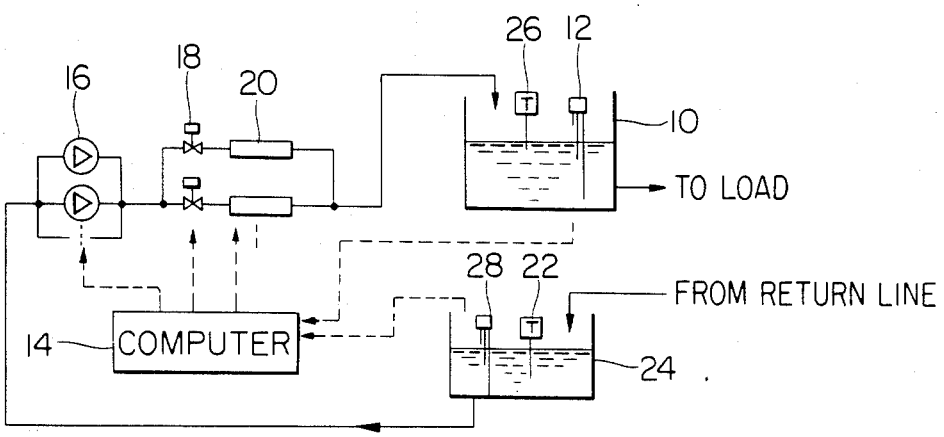
FIG. 1 PRIOR ART
FIG. 1 is a schematic diagram illustrating a prior art cold water supply system.
Figure 3:
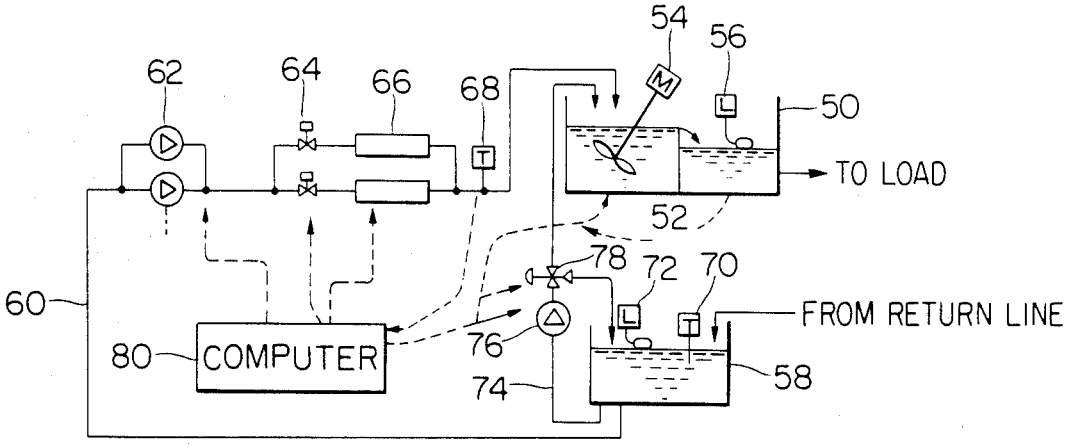
FIG. 3 is a schematic diagram illustrating the cold water supply system of the present invention.
Figure 2:
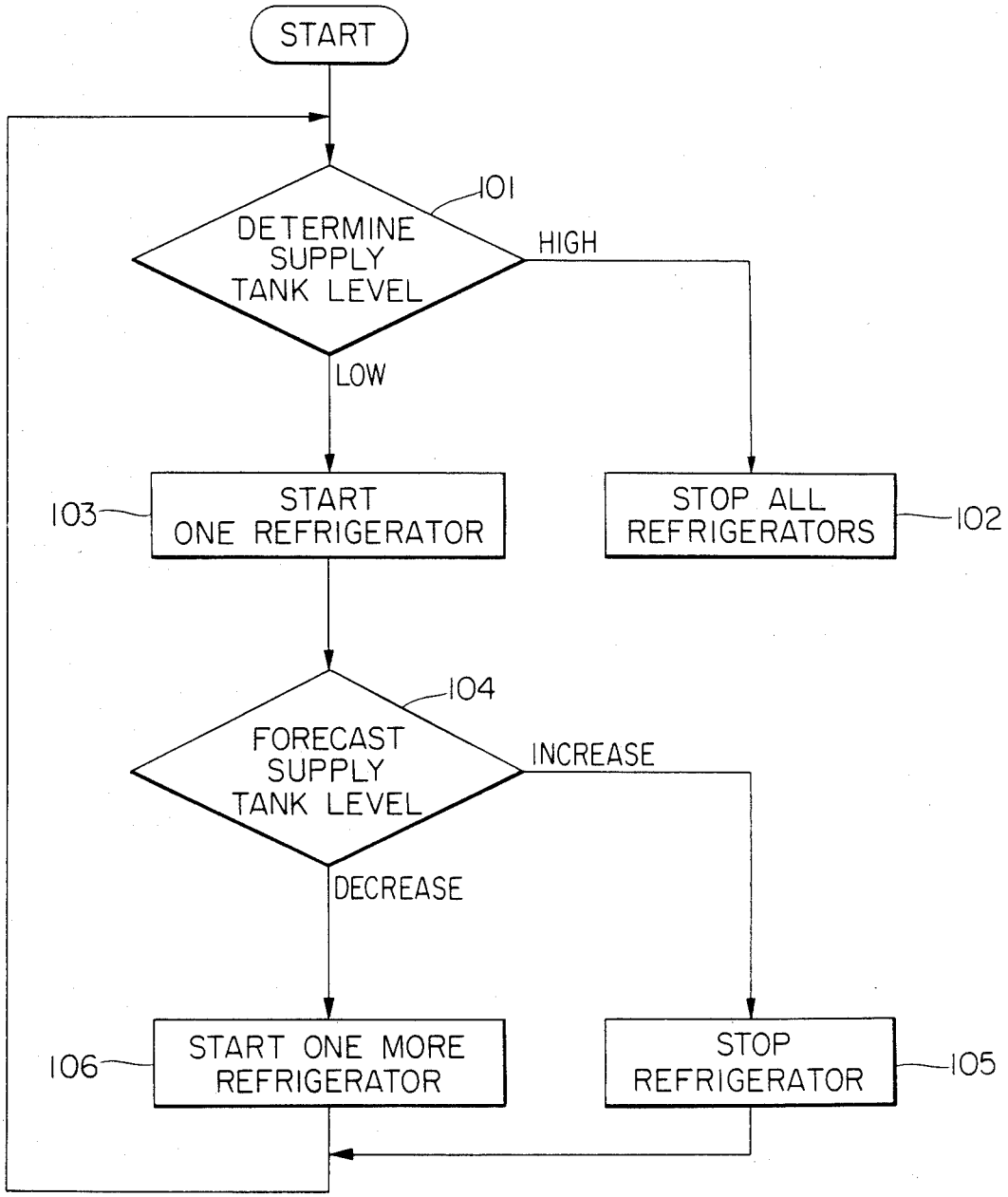
FIG. 2 PRIOR ART
FIG. 2 is a flow chart useful in explaining the operation of the system shown in FIG. 1.
Figure 4:
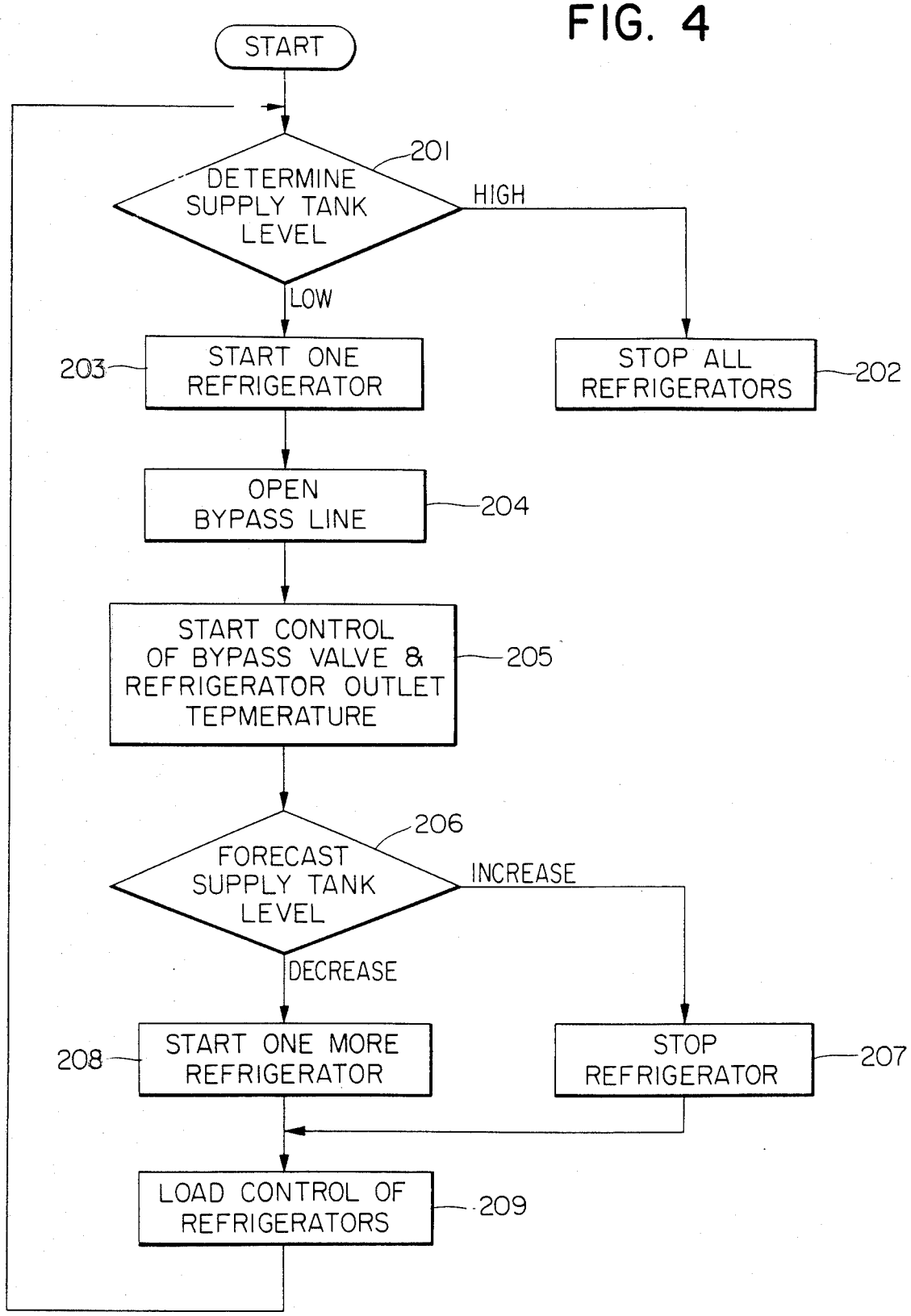
FIG. 4 is a flow chart illustrating the operation of the cold water supplying system shown in FIG. 3.

Referring now to FIGS. 3 and 4 in which one embodiment of the present invention is illustrated, there is shown that the cold water supply system of the present invention comprises a cold water supply tank 50 connected for supplying cold water to a load (not shown). The supply tank 50 has formed therein an agitator tank 52 in which an agitator 54 is disposed. The supply tank 50 also has a level sensor 56. The cold water supplied into the supply tank 50 is provided from a return water tank 58 connected to a return line (not shown) for receiving return water from the load. The return water in the return water tank 58 is supplied to the supply tank 50 through a supply line 60 including a plurality of pumps 62, valves 64 and refrigerators 66. The pumps 62 and series connections of the valves 64 and the refrigerators 66 are connected in parallel, and these parallel connections are connected in series. A temperature sensor 68 is disposed at the discharge end of the refrigerators 66. Another temperature sensor 70 and a level sensor 72 are disposed in the cold water return tank 58.

It is seen that the return tank 58 and the supply tank 50 are also connected by a bypass line 74 parallel to the supply line 60. The bypass line 74 connects both the tanks 58 and 50 so that a controlled amount of cold return water is supplied to the agitator tank 52 of the supply tank 50, and the bypass line 74 includes a pump 76 and a three-way valve 78 which is controllable to regulate the flow rate of the cold water toward the supply tank 50.

The cold water supply system of the present invention also comprises a computer 80 for regulating and controlling the operation of the cold water supply system. The computer 80 receives signals from various sensors such as the level sensor 56 in the supply tank 50, the temperature sensor 68 in the supply line 60, the level sensor 72 and the temperature sensor 70 in the cold water return tank 58. The computer 80 processes the received signals and provides various commands to the pumps 62, the valves 64 and the refrigerators 66 in the supply line 60, the agitator 54 in the supply tank 50, and the pump 76 and the three-way valve 78 in the bypass line 74. The flow of these sensor output signals and the computer commands are shown by arrows in dash line.

The operation of the cold water supply system of the present invention is illustrated in the flow chart of FIG. 4. The water level in the supply tank 50 is first determined by a function 201 if it is higher or lower than the level necessary for supplying cold water to the load. If the level is determined to be higher, the refrigerators 66 are all stopped as shown in function 202, and if the level is lower than the necessary level, only one of the refrigerators 66 in the refrigerating system is started up as shown in function 203 and at the same time the bypass line 74 including the pump 76 and the three-way valve 78 is started up as shown in function 204. The refrigerator 66 starts up at 100% of its refrigeration capacity, and the refrigerator discharge temperature measured by the temperature sensor 68 and the relatively hot water temperature measured by the temperature sensor 70, i.e., the temperature of the water that is to be supplied from the return tank 58 to the supply tank 50 through the bypass line 74. Then, a calorific calculation is carried-out based on the capacity of the pump 62 and the refrigerator discharge temperature measured by the temperature sensor 68 to calculate the flow rate of the relatively hot water that should be shifted from the return tank 58 to the agitator tank 52 in the supply tank 50 in order that the water temperature in the agitator tank becomes a predetermined constant temperature. This calculated flow rate is given as a command set value to the regulating three-way valve 78.

In the event that the water temperature in the supply tank 50 is not expected to become the set value even when the three-way valve 78 is opened by 100%, the refrigerators 66 are controlled such that their capacity is decreased or, more particularly, the computer 80 calculates the necessary capacity percentage of the refrigerators 66 to obtain the required discharge temperature and supplies it to the refrigerators 66 as capacity control commands as shown in a function 205.

Thus, the agitator tank 52 is supplied with cold water which is a sum of the flow from the refrigerators 66 and the flow from the bypass line 74 according to the temperature measured by the temperature sensor 70 in the return water tank 58. Therefore the water level in the supply tank 50 changes according to the difference between the above sum supply amount and the water flow from the supply tank 50 to the load. The computer 80, receiving the signal from the level sensor 56 in the supply tank 50 representative of the water level change rate in the supply tank 50, predicts the relative sizes between the in-flow and the out-flow amounts of the supply tank 50 as shown in function 206. When it is determined from this level change rate that the water level within the supply tank 50 is increasing, function 207 taking the actual water level in the supply tank also into consideration determines if the refrigerators 66 should be shut down. When it is determined from the level changing rate that the water level in the supply tank 50 is decreasing, function 208 taking the actual water level in the supply tank also into consideration determines if one more additional refrigerator 66 should be started up. When an additional refrigerator 66 is started up, the load control by the calorific calculation and the flow rate calculation similar to those carried out in the function 205 for a plurality of refrigerators is carried out.

The present invention has been described in conjunction with a single preferred embodiment, but various changes and modifications can be effected. For example, instead of the bypass line including the pump and the controllable three-way valve, a bypass line including a variable speed pump employing a variable voltage, variable frequency power source may be used with a computer controlled speed setting to control flow rate in the bypass line, enabling further saving in energy consumption. Also the present invention is equally applicable to a cold water supply system having a plurality of variable capacity refrigerators such as turbo or screw refrigerators.

As apparent from the foregoing description, the present invention increases the operating efficiency of the refrigeration units.

What is claimed is:

1. A cold water supplying system in which return water from a load cooled to a predetermined low temperature by a refrigeration system of a variable refrigerating capacity is stored in a cold water supply tank, and in which the flow rate of the return water for passing through said refrigerating system is regulated in accordance with a signal from a level detector disposed in the cold water supply tank, thereby maintaining a predetermined amount of cold water at a predetermined temperature within said cold water supply tank, comprising an agitating tank disposed within said cold water supply tank for receiving the cold water from said refrigerating system, a bypass piping means for directing a calculated amount of the return cold water into said agitator tank, a temperature measuring sensor for sensing the temperature of the return cold water, a refrigerating system outlet temperature detecting sensor for measuring the water temperature discharged from said refrigerating system, and a regulating means, which is responsive to said return cold water and refrigerating system discharge temperature sensors, for automatically regulating the cold water temperature supplied after being mixed from said refrigerating system and said bypass piping into said agitating tank to become said predetermined temperature; wherein said regulating means regulates said refrigeration system capacity and wherein said regulating means regulates said calculated amount of return cold water.

* * * * *